United States Patent [19]

Takai

[11] Patent Number: 4,763,118

[45] Date of Patent: Aug. 9, 1988

[54] GRAPHIC DISPLAY SYSTEM FOR PERSONAL COMPUTER

[75] Inventor: Yasuyuki Takai, Nara, Japan

[73] Assignee: Sharp Kabushiki Kaisha, Osaka, Japan

[21] Appl. No.: 728,864

[22] Filed: Apr. 30, 1985

[30] Foreign Application Priority Data

May 7, 1984 [JP] Japan ..... 59-91312

[51] Int. Cl.[4] ..... G09G 1/16

[52] U.S. Cl. ..... 340/735; 340/748; 340/703

[58] Field of Search ..... 340/701, 703, 735, 748, 340/750

[56] References Cited

U.S. PATENT DOCUMENTS 3,996,584 12/1976 Plager ..... 340/748
4,183,046 1/1980 Dalke et al. ..... 340/703
4,504,828 3/1985 Couper et al. ..... 340/735
4,520,356 5/1985 O'Keefe et al. ..... 340/703
4,563,677 1/1986 Seiler ..... 340/735
4,613,856 9/1986 Olin et al. ..... 340/735

*Primary Examiner*—Gerald L. Brigance
*Attorney, Agent, or Firm*—Birch, Stewart, Kolasch & Birch

[57] ABSTRACT

A graphic display circuit for driving a graphic display comprises a programmable character generator for storing character font data, a video RAM for storing display code data corresponding to characters in said font, an attribute RAM for storing block selection data for selecting one of the blocks of the character generator defining attributes of the character font data, and a controller for controlling the video RAM and attribute RAM.

3 Claims, 4 Drawing Sheets

GRAPHIC DISPLAY SYSTEM FOR PERSONAL COMPUTER

BACKGROUND OF THE INVENTION

The present invention relates to a display driving system and, more particularly, to an improved graphic display system for a computer such as a personal computer.

Conventionally, a graphic display circuit comprises a graphic display controller and a display memory. The display memory is provided for storing bit pattern information corresponding to a dot pattern of a picture to be displayed. To display a moving picture in such a display, the old dot pattern must be replaced by a new one. If the dot pattern has 10×10 dots, such an operation must be repeated 100 times. This will take a long time to replace one dot pattern.

SUMMARY OF THE INVENTION

Accordingly, it is an object of the present invention to provide an improved graphic display circuit comprising a programmable character generator and a video random access memory (V-RAM) which can change its contents using a program.

It is another object of the present invention to provide an improved graphic display circuit comprising a programmable character generator storing bit pattern information equivalent to a dot pattern of a display and a video random access memory (V-RAM) storing data in the form of character codes.

Briefly described, in accordance with the present invention, a graphic display driving circuit for driving a graphic display comprises programmable character generator means for storing display data, video random access memory (V-RAM) means for storing display code data corresponding to the characters, attribute RAM means for storing block selection data for selecting one of the blocks of the character generator defining attributes of the display data, and control means responsive to the video RAM means and the attribute RAM means for controlling the selection of a character font pattern in the programmable character generator means. The capacity of the programmable character generator means is adequate to display all of the characters in the display.

BRIEF DESCRIPTION OF THE DRAWINGS

The present invention will become more fully understood from the detailed description given hereinbelow and the accompanying drawings which are given by way of illustration only, and thus are not limitative to the present invention and wherein.

DESCRIPTION OF THE PREFERRED EMBODIMENT

Figure 1:
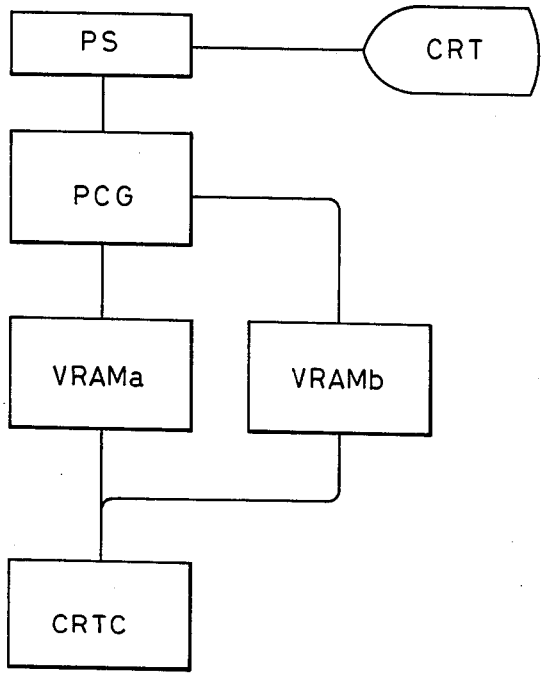
FIG. 1 is a block diagram of a graphic display system according to the present invention.

FIG. 1 is a block diagram of a graphic display driving system for enabling a graphic display in a computer such as a personal computer according to the present invention.

The circuit of FIG. 1 comprises a cathode-ray tube (CRT), a CRT controller CRTC, video random access memories (V-RAM) VRAMa and VRAMb, a programmable character generator PCG, and a parallel-serial conversion circuit PS.

Typically, a character generator (CG) comprises a read only memory (ROM). On the other hand, according to the present invention, the programmable character generator (PCG) comprises a random access memory (RAM) called a video RAM (V-RAM), so that the contents of the V-RAM can be changed by a program. The V-RAM stores the display code data in the form of the characters. The PCG writes-in the code information corresponding to the characters into the V-RAM to enable a display.

The VRAMa is provided for storing display codes. The VRAMb is provided for storing an attribute. The PCG is provided for storing font patterns corresponding to the character codes. The CRTC is provided for accessing the VRAMa and VRAMb.

The output code information from the VRAMa and VRAMb developed by the CRTC are inputted into the PCG, so that a particular font pattern is selected. That is, the display codes from the VRAMa are inputted into the PCG so that they are contained within the lower 8 bits of the character code. The attributes from the VRAMb are inputted into the PCG so that they are contained within the upper 2 bits of the character code. The total 10-bit character code can select 1024 types of characters.

FIGS. 2(A) and 2(B) show the format of the VRAMa and VRAMb, respectively, in the case where a graphic display has 40 characters (horizontal direction) and 25 characters (vertical direction), totally 1000 characters.

Referring to FIG. 2(A), the VRAMa stores, from the beginning, "00", "01", "02", "03", . . . , "FE", "FF", "00", "01", "02", . . . , "FE", "FF", "00", "01", . . . , "E7", repeatedly, data for 1000 characters in total. Referring to FIG. 2(B), the VRAMb stores "0" for the first group of 256 characters, "1" for the second group of 256 characters, "2" for the third group of 256 characters, and "3" for the final group of 232 characters, thus, totaling 1000 characters. When the CRTC accesses the VRAMa and VRAMb, the character codes inputted into the PCG are "000" through "3E7" in succession. By registering a bit pattern corresponding to a particular dot pattern in the PCG, a desired graphic display can be obtained.

Figure 3:
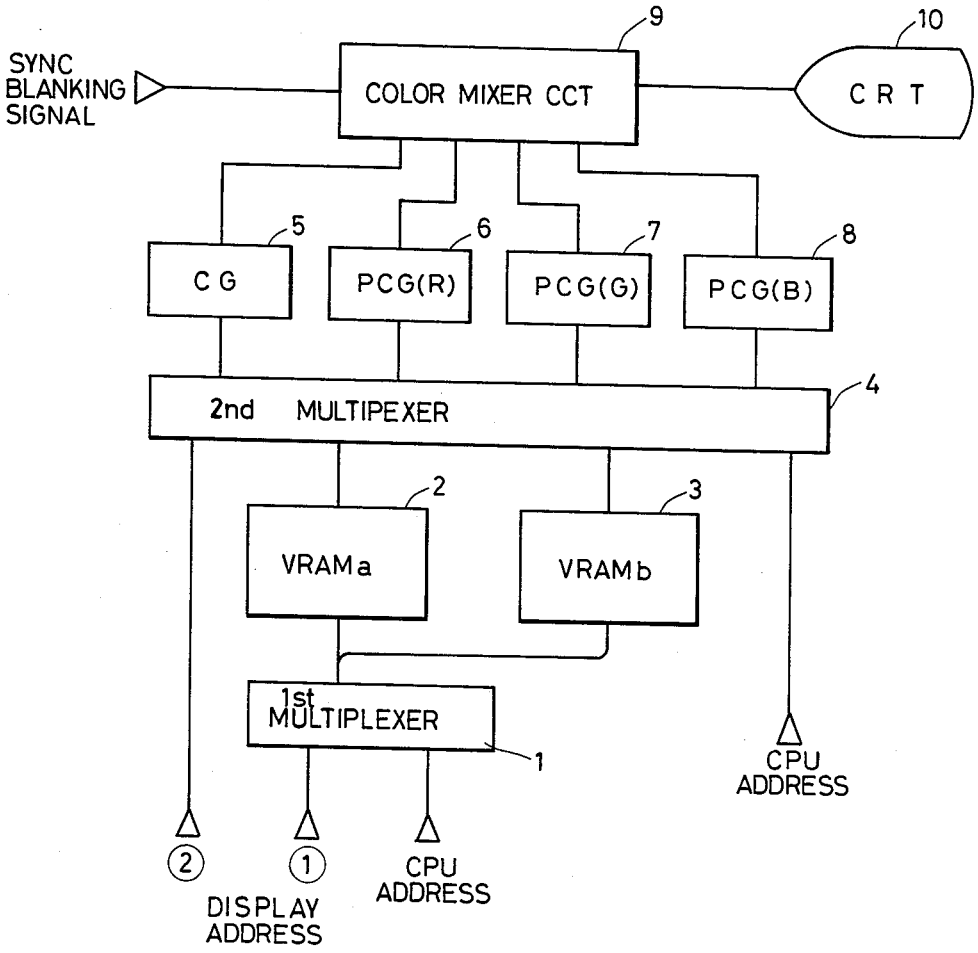
FIG. 3 is a block diagram of a color graphic display circuit according to the present invention.

FIG. 3 is a block diagram of a color graphic display circuit according to the present invention.

Figure 2:
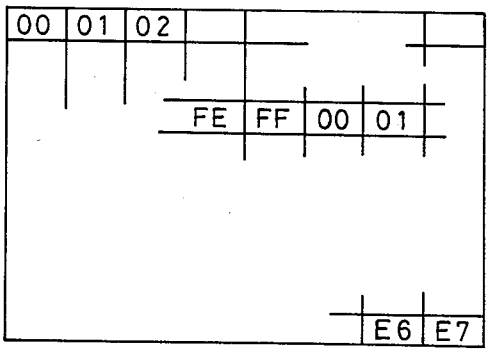
FIGS. 2(A) and 2(B) show the format of a video random access memory (V-RAM) connected in the graphic display system of FIG. 1.
Figure 2:
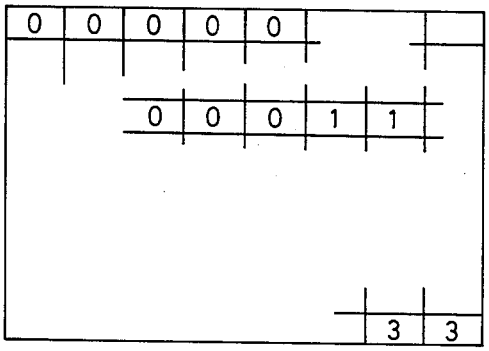

The CRTC of FIG. 2 provides display addresses, vertical-direction sync signals, horizontal-direction sync signals, and blanking signals. Display address ① designates a position of each character. Display address ② designates a position of each dot. A video-RAM VRAMa 2 is provided for storing the code data of characters. A video-RAM VRAMb 3 functions as an attribute RAM for storing data for switching the blocks in the PCG. A first multiplexer 1 is provided for communicating the display address ① and the CPU address to the VRAMa 2. Only when a central processing unit (CPU) accesses the VRAM, will the CPU address become effective.

A character generator (CG) 5 comprises a read only memory (ROM) for storing font data of preselected characters. PCG(R) 6, PCG(G) 7, and PCG(B) 8 are RAMs for storing font data for red, green, and blue characters, respectively. An attribute RAM (VRAMb) 3 is provided for switching the PCG(R), PCG(G), and PCG(B). By switching of the VRAMb 3, all the dots over the display can be selected because their capacity is sufficient to display all the dots in the display. Each of the CG 5, the PCG(R) 6, PCG(G) 7, and PCG(B) 8 comprises a shift register for outputting a display pattern to meet with a dot cross to be displayed. A second multiplexer 4 is provided for multiplexing the display address ②, the CPU address, and the output from the VRAMa and VRAMb. The CPU serves to access the CG and the respective PCGs during the non-display times, so that the data are written-in the respective PCGs and read-out from both the PCGs and the CG. A color mixer circuit 9 is responsive to the display pattern from the CG and the respective PCGs, as well as the vertical/horizontal-direction sync signals, and the blanking signals for composing display signals suitable for a CRT 10.

Figure 4:
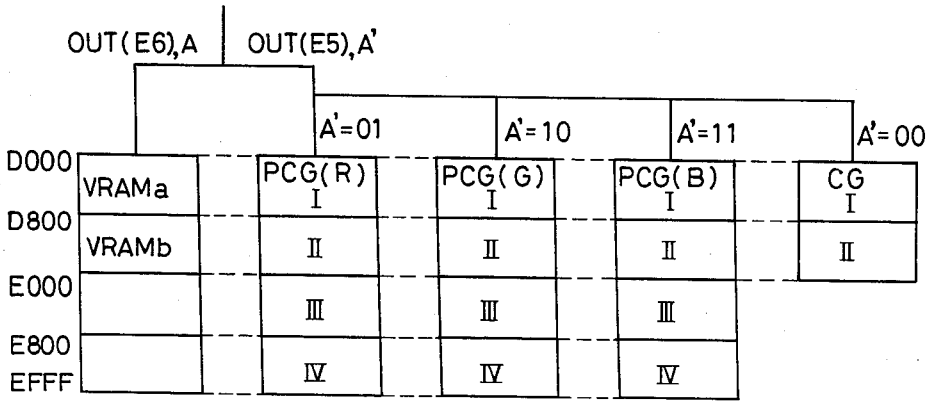
FIG. 4 shows a relation between the respective address maps in the locations of the memories.

FIG. 4 shows a relation between the address maps in the above memories.

The addresses of the VRAM, the three PCGs, and the CG can be switched by switching their bank. In particular;

To execute the instruction of OUT(E6) for OUT of A, addresses "D000" through "D7FF" are selected in the VRAMa while addresses "D800" through "DFFF" are selected in the VRAMb.

To execute the instuction of OUT(E5) for OUT of A' with A'=01, the PCG(R) is selected. If A'=10, the PCG(G) is selected. If A'=11, the PCG(B) is selected. If A'=00, the CG is selected.

The locations of the three PCGs are a block I corresponding to addresses "D000" through "D7FF", a block II corresponding to addresses "D800" through "DFFF", a block III corresponding to addresses "E000" through "E7FF", and a block IV corresponding to addresses "E800" through "EFFF". The locations of the CG are a block I corresponding to addresses "D000" through "D7FF", and a block II corresponding to "D800" through "DFFF". The four blocks I through IV are selected by the 2 bits in the attribute RAM.

Figure 5A:
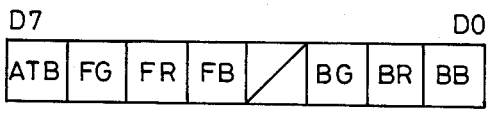
FIGS. 5(A) and 5(B) show the contents of an attribute of the V-RAM.
Figure 5B:
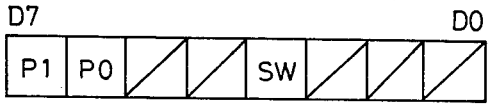

FIGS. 5(A) and 5(B) show the contents of the attributes of the VRAMb.

FIG. 5(A) shows the contents in the case where the CG is used. The highest bit "ATB" designates the selection of one of the blocks I and II of the CG. The codes "FG", "FR", and "FB" are used to select the color of the characters. The codes "BG", "BR", and "BB" are used to select the color of the background. This code information can define the attribute of the display codes stored within the VRAMa.

FIG. 5(B) shows the contents of the VRAMb in the case where the respective three PCGs are used. "P1" and "P0" are used to select one of the four blocks of the three PCGs. "SW" is used to determine whether either of the three PCGs is effective or not. When SW=0, the font pattern stored within the PCG is not outputted. If SW=1, it is outputted. Therefore, a particular display position can be prevented from being displayed, so that in reponse to a specific condition, it can be displayed.

Figure 6:
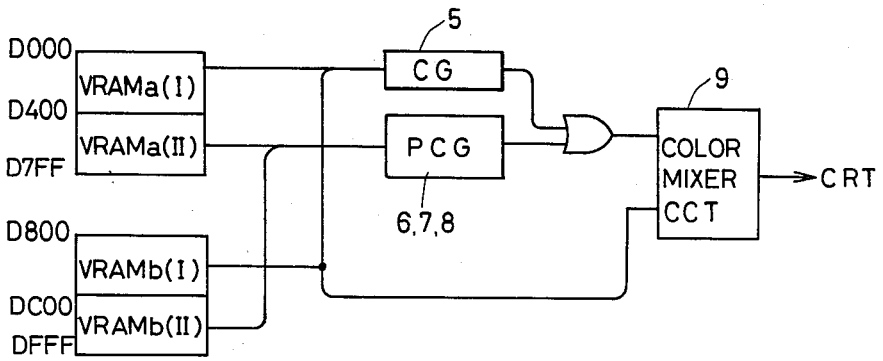
FIG. 6 shows a circuit connection relation between the V-RAM, a character generator (CG), and a programmable character generator (PCG)

FIG. 6 is a block diagram showing the relation between the VRAM, the CG, and the three PCGs.

Each of the VRAMa and VRAMb is divided into two parts each corresponding to a single picture screen. VRAMa(I), namely, from the addresses "D000" to "D3FF", is a loction in which the character code for selecting the CG is stored. VRAMb(I), namely, from the addresses "D800" through "DBFF", is a location in which the attribute of FIG. 5(A) is stored. VRAMa(II), namely, the addresses "D400" through "D7FF", is a location in which the display code selecting the PCG is stored. VRAMb(II), namely, the addresses "DC00" through "DFFF", is a location in which the attribute of FIG. 5(B) is stored.

With the arrangement of FIG. 6, both the CG and the PCG can be operated at the same time. Further, in the case of the graphic display, only the one-picture part character among 1024 characters can be used while the remaining 24 characters can be used for characters of the font patterns. That is, in addition to the graphic display, 24 kinds of characters by the PCG can be displayed at the same time.

Figure 7:
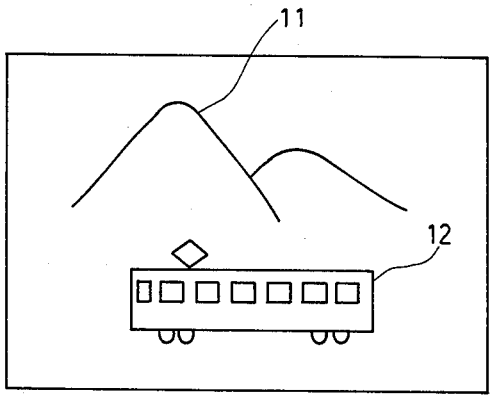
FIG. 7 shows a typical example of a graphic display.

FIG. 7 is a display example according to the circuit of the present invention. A still pattern 11 which cannot move is displayed in the graphic display. A moving pattern 12 such as a train can be displayed in the characters by the PCG. The train displayed can be moved quickly.

According to the present invention, the fast moving feature of the moving picture can be attained by the programmable character generator circuit (PCG). In addtion, a fine picture can be displayed with the graphic display.

The type of display is not limited to the CRT as referred to above. Any other types of displays can be adopted.

While only certain embodiments of the present invention have been described, it will be apparent to those skilled in the art that various changes and modifications may be made therein without departing from the sprit and scope of the present invention as claimed.

What is claimed is:

1. A circuit for driving a graphic display comprising:

programmable character generator means for storing a set of characters as display character font patterns in a plurality of blocks, each block representing a font, each font representing an attribute of said set of characters, the capacity of said programmable character generator means being sufficient to store a number of character patterns equal to the number of patterns capable of being simultaneously displayed on said display;

video random access memory (V-RAM) means for storing display code data corresponding to said characters;

attribute RAM means for storing block selection data for selecting one of the blocks of said character generator means; and control means responsive to said video RAM means and said attribute RAM means for controlling the selection of a character font pattern in said programmable character generator means.

2. A display circuit for driving a color graphic display, comprising:

programmable character generator means for storing color character font data of characters to be displayed;

read only memory (ROM) character generator means for storing character font data of characters to be displayed;

video random access memory (V-RAM) means for storing character code data corresponding to the color character font data and character font data stored in said programmable and ROM character generator means respectively;

attribute RAM means for storing color attribute data of the characters stored in said ROM character generator means, and selection data for determining whether specific color character font data stored in said programmable generator means are to be displayed; and control means responsive to said V-RAM means and said attribute RAM means for controlling the selection of character font data in said programmable and ROM character generator means, said programmable and ROM character generator means being simultaneously selectable to enable the display of a moving character pattern superimposed on a stationary background pattern stored in said programmable and ROM character generator means respectively.

3. The circuit of claim 2, wherein said programmable character generator means comprises separate generator means for each color to be displayed in the display.

* * * * *